United States Patent [19]

Johnson

[11] 4,008,681

[45] Feb. 22, 1977

[54] BUTTER DISPENSER

[76] Inventor: Patrick Steven Johnson, Apt. K-4 1617 Lebanon Road, Nashville, Tenn. 37210

[22] Filed: June 19, 1975

[21] Appl. No.: 588,281

[52] U.S. Cl. ..... 118/5; 118/13; 118/202; 118/203

[51] Int. Cl.[2] ..... B05C 1/02; B05C 11/10

[58] Field of Search ..... 118/5, 13, 202, 203

[56] References Cited

UNITED STATES PATENTS

| | | | |
|---|---|---|---|
| 2,072,663 | 3/1937 | Bedford | 118/13 |
| 2,693,429 | 11/1954 | Radtke et al. | 118/202 X |
| 3,352,279 | 11/1967 | Lockwood | 118/202 X |
| 3,752,114 | 8/1973 | Knight | 118/202 X |

*Primary Examiner*—John P. McIntosh
*Attorney, Agent, or Firm*—Abe Hatcher

[57] ABSTRACT

An L-shaped butter dispenser having a heated grid for melting butter. The dispenser is adapted for the melted butter to drip down onto a slanted floor, flow therealong and be taken up and dispensed by a rotatable roller near the lower end of said floor.

10 Claims, 3 Drawing Figures

BUTTER DISPENSER

BACKGROUND OF THE INVENTION

1. Field of the Invention

This invention relates to apparatus for buttering bread. More particularly, it relates to an improved roller device for dispensing butter and buttering bread therewith.

2. Description of the Prior Art

Roller devices for buttering bread have been used for several years, but with only limited success. For example, feed lines tend to clog due to congealing or hardening of the melted butter, and the melted butter is often not taken up evenly by the rollers from the pan container. After extended investigation I have developed a butter dispenser which alleviates these and other problems heretofore encountered in buttering bread by means of rollers.

SUMMARY OF THE INVENTION

In its broad aspects my invention involves a buttering device made up of a heatable grated hot plate inside a cabinet with an openable hinged top, a basin with slanted floor underneath the hot plate for receiving and holding butter after it is melted on the hot plate, and one or more rollers adapted to pick up melted butter from the basin. The basin extends beyond one side of the cabinet to make the device generally L-shaped, the basin portion preferably being the longer portion of the L. The basin is so constructed that it may be pulled out like a drawer for cleaning, including a heating unit, preferably beneath the slanted floor thereof. The heating unit is preferably electrical, such as a radiant coil, but may be a gas unit, if desired. According to my invention there may be a window in one or both sides of the basin. It is preferred to use only one large roller near the lower end of the slanted floor of the basin to pick up the butter from the basin by moving slices of bread thereacross and turning thereby. However, the roller may be turned mechanically or electrically, if preferred, and there may be additional rollers, large, small, or both, if desired. A screen may be positioned in a slanted manner at the drawer end of the basin so as to press against the roller as it turns counterclockwise and conduct crumbs or the like toward a thermos-type drain, which may be attached near the bottom of the pull-out end of the drawer-basin.

A heating unit, preferably electric, encircles the grated hot plate, although gas burners may be employed, if desired. According to the invention, the grated hot plate may be sloped toward the center so as to better drain the butter therethrough into the basin as it melts.

BRIEF DESCRIPTION OF THE DRAWING AND DESCRIPTION OF THE PREFERRED EMBODIMENT

For a better understanding of my invention, reference will now be made to the drawing, which shows a preferred embodiment.

Figure 2:
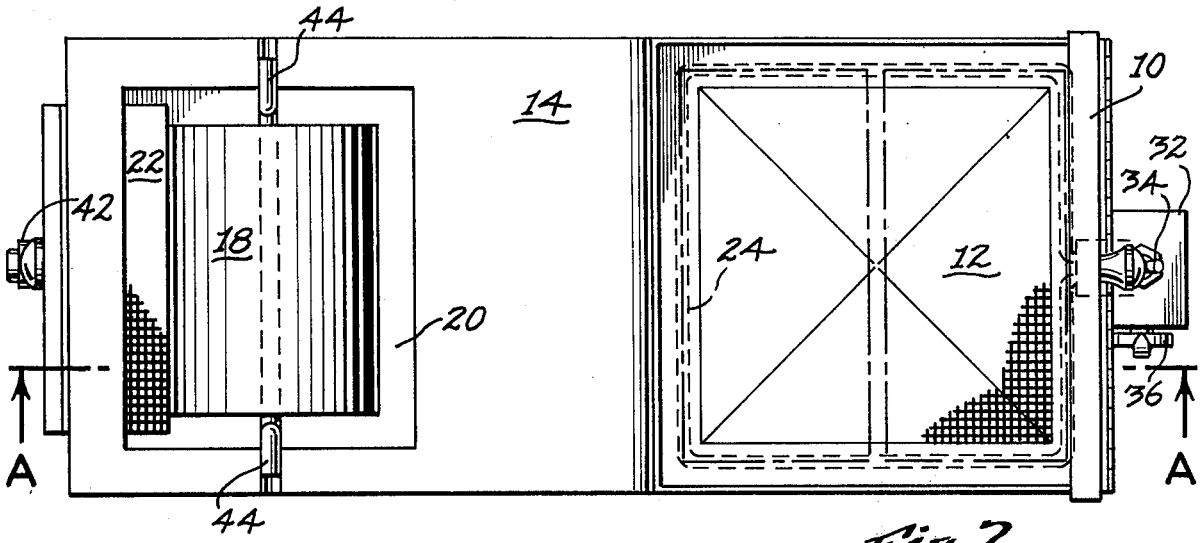
FIG. 2 is a top view of the butter dispenser of FIG. 1.
Figure 1:
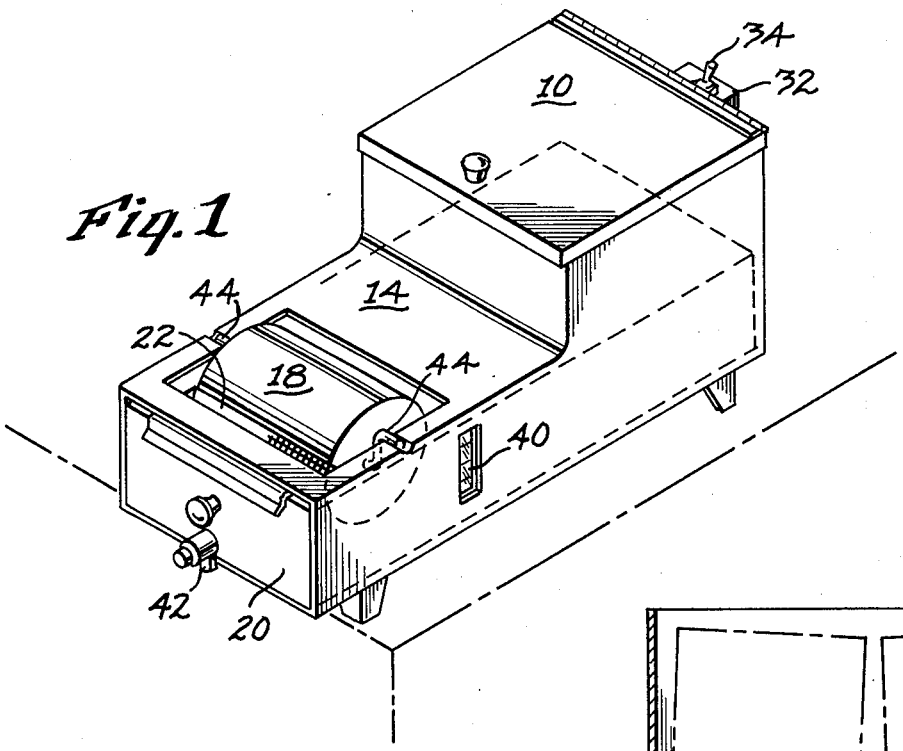
FIG. 1 is a perspective view of the butter dispenser of the invention.
Figure 3:
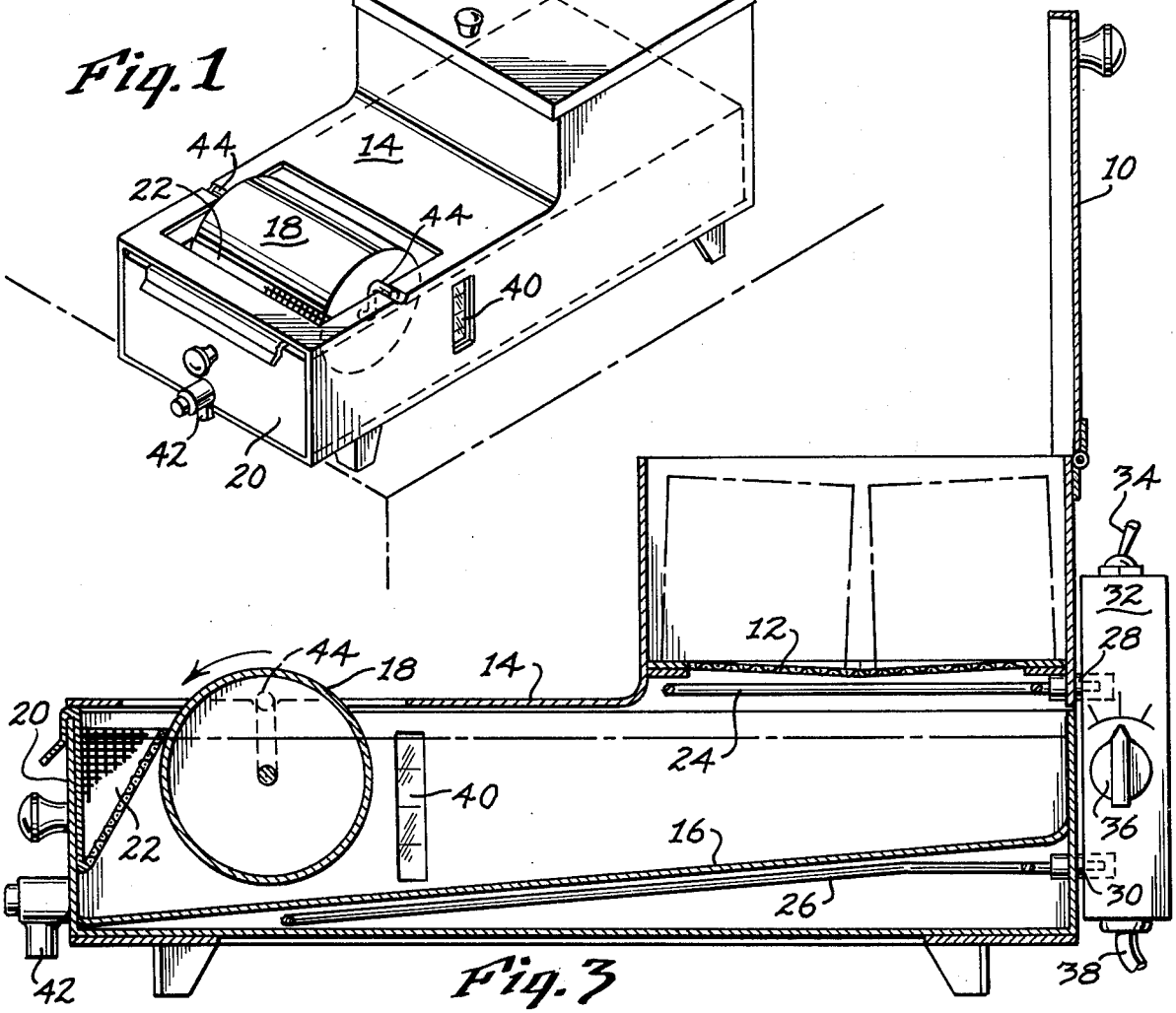
FIG. 3 is a side view of the butter dispenser taken at A—A of FIG. 2.

In the drawing, butter, for example, in chunks, is added after opening top door 10 and melted on center-sloped grated hotplate 12 by heating means 24, preferably one or more radiant electrical coils 24 going around the four sides of the hot plate and connected via plug 28 to a thermostatically controlled electrical heating unit 32 operated by switch 34, having a thermostat controlled by Knob 36 and a line 38 coming thereto from a source of electricity (not shown). The melted butter falls through grate 12 onto the sloping floor 16 of basin 14, preferably heated by electrical means 26 such as a coil connected via plug 30 to unit 32. The melted butter flows along slanted floor 16 and is taken up by roller 18, which has handles 44 for positioning and removing same, and applied to slices of bread moving over same. The whole basin, including heating means 26, may be pulled out at drawer end 20, which has a thermos-type drain spout 42 thereon. A window 40 is provided in the side of drawer-basin 14. Substantially all parts of the butter dispenser may be made of metal, although the roller 18 may be wooden. A catch-all screen is provided at 22.

While the invention has been described in terms of preferred embodiments, the claims appended hereto are intended to encompass all embodiments which fall within the spirit of the invention.

Having thus described my invention and certain preferred embodiments thereof, I claim:

1. A butter dispenser comprising a three-dimensional L-shaped enclosed frame, the upright arm of said L having an openable top and a heatable grate below said top, the other arm of said L having a basin fitted therein as a drawer, said basin having at least one roller at least partly submerged therein along the other arm of said L and held in position by handles adapted for removing same, said roller being rotatable clockwise and counterclockwise along the direction of protrusion of said other arm of said L, and means for heating said basin and said grate.

2. The dispenser of claim 1 having only one roller.

3. The dispenser of claim 1 having a floor in said basin slanting downward toward the roller end thereof.

4. The dispenser of claim 1 having a window in at least one side of said basin.

5. The dispenser of claim 1 wherein the central portion of said grate is lower than the periphery thereof.

6. The dispenser of claim 1 having a screen in juxtaposition with said roller adapted to remove particles adhering to said roller.

7. The dispenser of claim 1 wherein said basin has a spigot near the bottom at the end thereof opposite the upright arm of the L.

8. The dispenser of claim 1 wherein said dispenser is heated by electrical coils under said grate and near the bottom of said basin.

9. The dispenser of claim 1 wherein said basin is heated by one or more electrical coils near the bottom thereof.

10. The dispenser of claim 1 having a single roller, a slanted floor in said basin, at least one window in said basin, a screen in juxtaposition with the roller, a spigot at the drawer end of said basin opposite the upright arm end, separate electrical coils for heating said grate and said basin, a thermostatically controlled heating unit connected to said coils, means for connecting said unit to a source of electricity, and a slope in said grate downward toward the center thereof.

* * * * *